United States Patent [19]

Burrell

[11] Patent Number: 4,559,730

[45] Date of Patent: Dec. 24, 1985

[54] SYSTEM FOR LABELLING STORAGE DRAWERS

[76] Inventor: Alfred A. Burrell, 10223-133th St., Edmonton, Alberta, Canada

[21] Appl. No.: 469,307

[22] Filed: Feb. 24, 1983

[51] Int. Cl.[4] ..... G09F 3/00

[52] U.S. Cl. ..... 40/324; 40/10 R; 40/16

[58] Field of Search ..... 40/324, 325, 27.5, 625, 40/5, 10 R, 16; 116/41

[56] References Cited

U.S. PATENT DOCUMENTS

| | | | |
|---|---|---|---|
| 332,208 | 12/1885 | Noel | 40/5 |
| 729,351 | 5/1903 | Kade | 40/325 |
| 1,202,488 | 10/1916 | Crosby | 40/5 |
| 1,209,998 | 12/1916 | Pinckert | 40/27.5 |
| 2,043,760 | 6/1936 | Marsh | 40/10 R |
| 3,251,150 | 5/1966 | Sedgwick et al. | 40/625 |

FOREIGN PATENT DOCUMENTS

| | | | |
|---|---|---|---|
| 640144 | 5/1962 | Italy | 40/618 |

*Primary Examiner*—Gene Mancene
*Assistant Examiner*—Wenceslao J. Contreras
*Attorney, Agent, or Firm*—Kenyon & Kenyon

[57] ABSTRACT

A storage compartment labelling system comprising an attachment for a visible front face of each storage compartment, the attachment including an upwardly and backwardly sloping front panel, an opening in the panel, an insert adapted to be removably inserted into the opening and adapted to display information relating to the contents of the compartment to which the attachment is attached, and a support surface behind a major lower portion of the opening for supporting the insert in the opening, and wherein at least one of the orientation of the insert in the opening and the face of the insert to be displayed is selectively variable.

13 Claims, 4 Drawing Figures

SYSTEM FOR LABELLING STORAGE DRAWERS

BACKGROUND OF THE INVENTION

This application relates to a system for labelling or indexing storage drawers and the like, and more particularly, to such a system which will readily provide an indication of contents, absence of contents or disarrangement of contents.

Particularly in the industrial or commercial storage of small or medium sized stock items in small or multi-compartmented drawers, bins or the like, a number of difficult and time consuming problems of stock control arise. Since stock may be stored in large numbers of similar drawers or bins, easy and fast identification of the location of a particular stock item is necessary. As well, when a particular item is depleted or exhausted, it would be desirable to provide for the stock controller a simple and efficient means of indicating that new stock must be ordered, with a minimum of paperwork and avoiding the very time consuming process of continuously examining each drawer or bin and making a written record of any reorder action required. Another problem, particularly in storage of large inventories of differing small or medium sized items is that they tend to become mixed and stored in wrong drawers or bins as persons draw from the inventory. To correctly replace such items in their proper drawers or bins is again a time consuming endeavour. These types of problems are more often experienced in mill and factory maintenance stores and the like, as well as in large retail stores.

The present invention is directed toward a system of labelling for drawers, bins or the like which is aimed at reducing the time consuming nature of the problems discussed above.

PRIOR ART

The applicant is unaware of any prior art which provides a system similar to that of the present invention. Solutions to the aforementioned problems have centred around more rigorous inventory controls and checks, including periodic inspections of each drawer or bin, and restriction of access to stock inventory storage areas to only a few designated persons and the like. The system is particularly useful with, although it forms no part of, the stock display and storage stand described and claimed in applicant's earlier Canadian Pat. No. 3,856,370, issued Dec. 24, 1974.

SUMMARY OF THE INVENTION

In order to identify the contents of stock-containing drawers or bins or the like, and to optionally provide an indication that they contain improperly stored items or depleted stock items, it has been found to be of significant benefit to provide a simple visual indicator for the drawer or bin. The externally visible indicator is adjustable, for example, by a user of the drawer or bin, to indicate that a problem exists, the adjusted indicator being readily perceived at a glance by a stock controller, storekeeper or the like.

Thus, the invention provides a storage compartment labelling system comprising an attachment for a visible front face of each said storage compartment, said attachment including an upwardly and backwardly sloping front panel; an opening in said panel; an insert adapted to be removably inserted into said opening and adapted to display information relating to the contents of the compartment to which said attachment is attached; and a support surface behind a major lower portion of said opening for supporting said insert in said opening; and wherein at least one of the orientation of said insert in said opening and the face of said insert to be displayed is selectively variable.

BRIEF DESCRIPTION OF THE DRAWINGS

These and other objects and advantages of the present invention will become apparent upon reading the following detailed description and upon referring to the drawings in which.

DETAILED DESCRIPTION OF THE PREFERRED EMBODIMENTS

Figure 1:
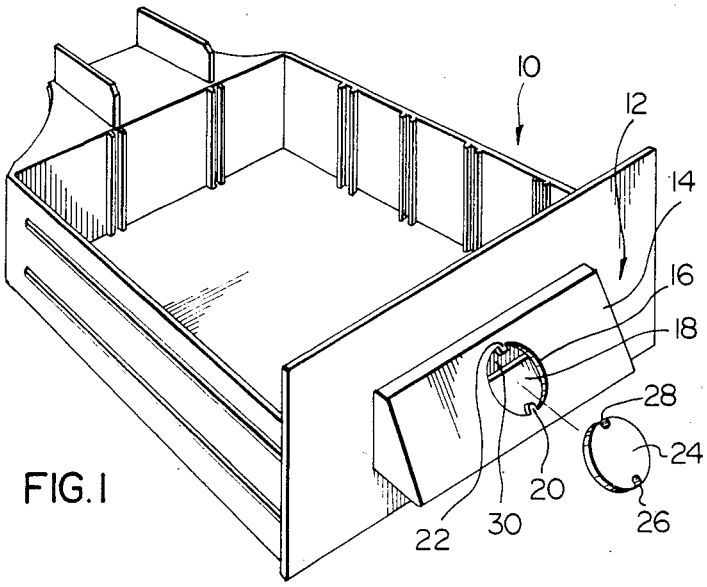
FIG. 1 is a perspective view of a drawer utilizing a preferred embodiment of the labelling system of the invention but with the drawer pull insert shown in an exploded position.

With reference to the drawings, the drawer 10 has attached thereto a drawer pull 12. Drawer pull 12 includes an upwardly and backwardly inclined panel 14 containing an opening 16. The opening 16 is partially closed off by the supporting surface 18. The opening 16 is essentially circular in shape and in the preferred case, as illustrated, is interrupted by the two opposing projections 20 and 22.

Figure 2:
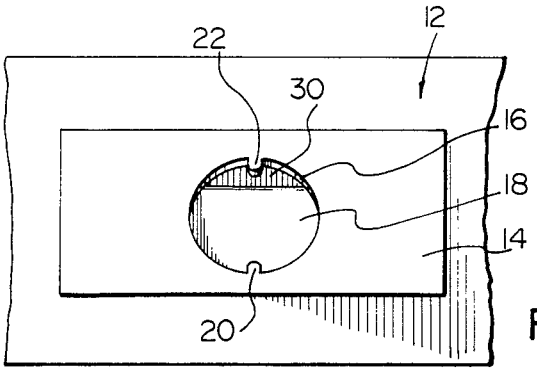
FIG. 2 is a front elevation of the drawer pull of FIG. 1 with the insert removed.
Figure 3:
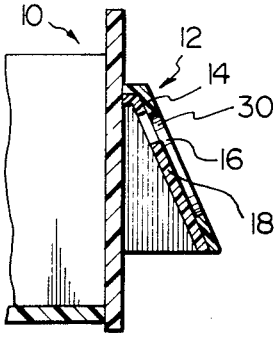
FIG. 3 is an end elevation of the drawer pull of FIG. 1.

As indicated in FIG. 2, the supporting surface 18 is disposed across a backside of the panel 14 to cover over a major portion of the opening 16 while defining a second opening aligned with the opening 16 in the panel.

The insert 24 is essentially circular in shape to conform with the opening 16 and includes the opposing indentation 26 and 28, corresponding in size and shape to projections 20 and 22. The insert 24 is slightly smaller in area than the opening 16 so that the insert will fit snugly within the opening 16. As indicated in FIG. 1, the insert 24 is to be fitted within the opening 16 against the supporting surface 18 and over the opening defined by the supporting surface 18 and aligned with the opening 16.

While the preferred configuration of the opening 16 and insert 24 is as illustrated, the details of size, shape, and system of projections may be varied as required. For example, the projections could be on insert 24 and the indentation on opening 16. Similarly, shapes other than circular could be utilized.

In all cases it is preferred that the relationship between the insert 24 and the supporting surface 18 be such that the insert 24 will rest securely against the supporting surface 18 but can be readily removed therefrom by directed finger pressure exerted on that part of insert 24 located over that portion 30 of opening 16 that is not backed by supporting surface 18. To this end, the insert 24 is disposed to pivot about the support surface 18 outwardly of the panel 14 in response to the pressure exerted thereon. In the preferred case portion 30 will be as small as is practicable consistent with ease of removal of insert 24. The insert 24 will thus be stable in the inserted position against inadvertent pressure over most of its surface. As a minimum, the supporting surface 18 will back half of the opening 16.

Figure 4:
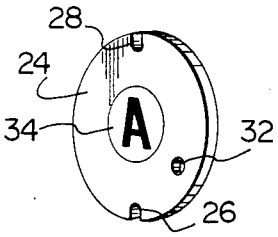
FIG. 4 illustrates the insert for the drawer pull of FIG. 1.

Several types of indicia can be utilized with insert 24, depending on the information required to be conveyed. For example, as illustrated in FIG. 4, the insert 24 has been provided with an opening 32 offset to one side. The side upon which the opening 32 appears to the user can be altered by removing and repositioning insert 24. The appearance of the opening 32 to the left may indicate that the drawer requires no attention, while the appearance of the opening 32 to the right may indicate that restocking or rearranging is in order. The insert 24 would be placed in the latter position by a regular check or by whichever user first perceived the difficulty. The individual whose responsibility it is will then have no difficulty in locating drawers requiring action.

A further type of indicia with a similar function contemplates the use on the insert 24 of a label such as that shown at 34. Instructions can be read from the position of the label. The label may be upside down or out of sight behind insert 24 as dictated by the system in use. The label 34 could simply be a colour code with a different colour appearing on the reverse of insert 24.

Any similar type of indicia or combinations thereof can clearly be used to convey the required information. The system will be most efficient, however, when a minimum number of indicia are used, bearing in mind that the user, when a maintenance worker or the like, will in many cases have little perceived interest in the success of the system.

Thus it is apparent that there has been provided in accordance with the invention a system for labelling storage drawers that fully satisfies the objects, aims and advantages set forth above. While the invention has been described in conjunction with specific embodiments thereof, it is evidence that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A storage compartment labelling system comprising an attachment for a visible front face of each said storage compartment, said attachment including an upwardly and backwardly sloping front panel having a front face;

an opening in said front face of said panel;

a plate-like insert adapted to be removably inserted into said opening and adapted to display information relating to the contents of the compartment to which said attachment is attached, said insert conforming in shape to said opening and, when inserted, being flush with said front surface of said panel;

a support surface behind a major lower portion of said opening for supporting a lower portion of said insert and leaving an upper portion unsupported, whereby the application of pressure to said unsupported part will cause said insert to drop out of said opening; and and wherein at least one of the orientation of said insert in said opening and the face of said insert to be displayed is selectively variable to thereby vary said information display.

2. A drawer labelling system comprising a drawer pull having a front panel sloped upwardly and backwardly, said panel having a front face;

an opening in said front face of said panel;

a plate-like insert adapted to be removably inserted into said opening and adapted to display information relating to the contents of the drawer to which said drawer pull is attached, said insert conforming in shape to said opening and, when inserted, being flush with said front face of said panel;

a support surface behind a major lower portion of said opening for supporting a lower portion of said insert and leaving an upper portion unsupported, whereby the application of pressure to said unsupported part will cause said insert to drop out of said opening; and and wherein at least one of the orientation of said insert in said opening and the face of said insert to be displayed is selectively variable to thereby vary said information display.

3. The system of claim 2 wherein said opening is circular, the circumference thereof includes a projection projecting into the opening, and said insert includes an indentation corresponding to said projection, such that at least the face of said insert to be displayed is selectively variable.

4. The system of claim 3 wherein said opening includes two said projections disposed on opposite sides of said opening and wherein said insert contains two corresponding indentations, whereby the orientation of said insert in said opening and the face of said insert to be displayed are selectively variable.

5. The system of claim 3 or 4 wherein the said insert contains integral indicia whereby the orientation of the insert can be readily determined.

6. The system of claim 3 or 4 wherein the said support surface extends under at least the lower half of the area of said opening.

7. The system of claim 3 wherein said opening is circular, the circumference thereof includes an indentation, and said insert includes a projection corresponding to said indentation, such that at least the face of said insert to be displayed is selectively variable.

8. The system of claim 7 wherein said opening includes two said indentations disposed on opposite sides of said opening and wherein said insert contains two corresponding projections, whereby the orientation of said insert in said opening and the face of said insert to be displayed are selectively variable.

9. The system of claim 7 or 8 wherein the said insert contains integral indicia whereby the orientation of the insert can be readily determined.

10. The system of claim 7 or 8 wherein the said support surface extends under at least the lower half of the area of said opening.

11. A drawer labelling system comprising a drawer pull having a front panel sloped upwardly and backwardly;

a circular opening in said panel;

two projections projecting into said opening on opposite sides thereof;

a plate like insert adapted to be removably inserted into and conforming in shape to said opening, said insert having a face flush with a front surface of said panel adapted to display information relating to the contents of the drawer to which said drawer pull is attached and including a pair of indentations corresponding to said projections whereby the orientation of said insert in said opening and said face of said insert are selectively variable; and a support surface behind a major lower portion of said opening for supporting said insert in said opening.

12. In combination a drawer pull having an inclined panel containing an opening and a supporting surface disposed across a backside of said panel to cover over a major portion of said opening while defining a second opening aligned with said opening in said panel; and a removable insert shaped to fit within said opening of said panel against said supporting surface and over said second opening with a face flush with a front face of said panel; said insert being disposed to pivot outwardly of said panel in response to a pressure exerted on a part of said insert disposed over said second opening.

13. The combination as set forth in claim 12 wherein said insert is of circular plate-like shape.

* * * * *